US010919293B2

(12) United States Patent
Yamaguchi et al.

(10) Patent No.: US 10,919,293 B2
(45) Date of Patent: Feb. 16, 2021

(54) LIQUID DISCHARGE APPARATUS AND LIQUID DISCHARGE METHOD

(71) Applicants: Kohhei Yamaguchi, Kanagawa (JP); Nobuyuki Satoh, Kanagawa (JP); Suguru Yokozawa, Kanagawa (JP)

(72) Inventors: Kohhei Yamaguchi, Kanagawa (JP); Nobuyuki Satoh, Kanagawa (JP); Suguru Yokozawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/526,132

(22) Filed: Jul. 30, 2019

(65) Prior Publication Data

US 2020/0039211 A1 Feb. 6, 2020

(30) Foreign Application Priority Data

Jul. 31, 2018 (JP) ..... 2018-144619
Jun. 19, 2019 (JP) ..... 2019-114058

(51) Int. Cl.
*B41J 2/045* (2006.01)
*B41J 2/15* (2006.01)
*B41J 2/165* (2006.01)

(52) U.S. Cl.
CPC ..... *B41J 2/0451* (2013.01); *B41J 2/15* (2013.01); *B41J 2/16579* (2013.01)

(58) Field of Classification Search
CPC ..... B41J 2/0451; B41J 2/15; B41J 2/16579; B41J 2/16517
See application file for complete search history.

(56) References Cited

U.S. PATENT DOCUMENTS

2009/0058920 A1* 3/2009 Endo ..... B41J 2/16579 347/19
2010/0328383 A1* 12/2010 Yoshikawa ..... B41J 2/04556 347/12

(Continued)

FOREIGN PATENT DOCUMENTS

JP 2009-274313 11/2009

OTHER PUBLICATIONS

U.S. Appl. No. 16/294,510, filed Mar. 6, 2019, Suguru Yokozawa, et al.

*Primary Examiner* — Justin Seo
(74) *Attorney, Agent, or Firm* — Harness, Dickey & Pierce, P.L.C.

(57) ABSTRACT

A liquid discharge apparatus includes a liquid discharge head, a scanning device, a conveyance device, a reading device, control circuitry, and a detecting device. The liquid discharge head is configured to discharge liquid to a target object. The scanning device is configured to move the liquid discharge head in a main scanning direction. The conveyance device is configured to convey the target object in a direction perpendicular to the main scanning direction. The reading device is disposed at a predetermined position with respect to the liquid discharge head. The control circuitry is configured to change a detection pattern image for detecting a defective nozzle, in accordance with a feed amount of the target object in the sub-scanning direction. The detecting device is configured to identify a nozzle corresponding to a defective portion of the detection pattern image read by the reading device.

8 Claims, 12 Drawing Sheets

(56) References Cited

U.S. PATENT DOCUMENTS

| | | | | |
|---|---|---|---|---|
| 2012/0050378 | A1* | 3/2012 | Kido | B41J 2/2139 347/19 |
| 2012/0069411 | A1 | 3/2012 | Satoh et al. | |
| 2014/0009529 | A1* | 1/2014 | Teshigawara | B41J 2/16517 347/23 |
| 2014/0218754 | A1 | 8/2014 | Satoh et al. | |
| 2015/0158309 | A1 | 6/2015 | Fujii et al. | |
| 2015/0375498 | A1 | 12/2015 | Horikawa et al. | |
| 2016/0004202 | A1 | 1/2016 | Morita et al. | |
| 2016/0031250 | A1 | 2/2016 | Yokozawa et al. | |
| 2016/0171348 | A1 | 6/2016 | Satoh et al. | |
| 2016/0243866 | A1 | 8/2016 | Yokozawa et al. | |
| 2016/0279992 | A1* | 9/2016 | Aoi | B41J 29/38 |
| 2016/0347052 | A1 | 12/2016 | Kawarada et al. | |
| 2017/0272617 | A1 | 9/2017 | Satoh et al. | |
| 2017/0361605 | A1 | 12/2017 | Kawarada et al. | |
| 2018/0141329 | A1 | 5/2018 | Aoyagi et al. | |
| 2018/0141359 | A1 | 5/2018 | Kawarada et al. | |
| 2018/0147835 | A1 | 5/2018 | Nakamura et al. | |
| 2019/0283447 | A1* | 9/2019 | Yokozawa | B41J 2/15 |

* cited by examiner

| Y | C | M | K | Y | C | M | K |
|---|---|---|---|---|---|---|---|
| 125 | 127 | 126 | 128 | 121 | 123 | 122 | 124 |
| 117 | 119 | 118 | 120 | 113 | 115 | 114 | 116 |
| 109 | 111 | 110 | 112 | 105 | 107 | 106 | 108 |
| 101 | 103 | 102 | 104 | 97 | 99 | 98 | 100 |
| 93 | 95 | 94 | 96 | 89 | 91 | 90 | 92 |
| 85 | 87 | 86 | 86 | 81 | 83 | 82 | 84 |
| 77 | 79 | 78 | 80 | 73 | 75 | 74 | 76 |
| 69 | 71 | 70 | 72 | 65 | 67 | 66 | 68 |
| 61 | 63 | 62 | 64 | 57 | 59 | 58 | 60 |
| 53 | 55 | 54 | 56 | 49 | 51 | 50 | 52 |
| 45 | 47 | 46 | 48 | 41 | 43 | 42 | 44 |
| 37 | 39 | 38 | 40 | 33 | 35 | 34 | 36 |
| 29 | 31 | 30 | 32 | 25 | 27 | 26 | 28 |
| 21 | 23 | 22 | 24 | 17 | 19 | 18 | 20 |
| 13 | 15 | 14 | 16 | 9 | 11 | 10 | 12 |
| 5 | 7 | 6 | 8 | 1 | 3 | 2 | 4 |

FIG. 12

| |
|---|
| HEAD 1-1 (32 ROWS) IN FIRST SCAN |
| HEAD 1-2 (32 ROWS) IN FIRST SCAN |
| HEAD 1-3 (32 ROWS) IN FIRST SCAN |
| HEAD 1-4 (32 ROWS) IN FIRST SCAN |
| HEAD 1-5 (32 ROWS) IN FIRST SCAN |
| HEAD 1-6 (32 ROWS) IN FIRST SCAN |
| HEAD 1-7 (32 ROWS) IN FIRST SCAN |
| HEAD 1-8 (32 ROWS) IN FIRST SCAN |
| HEAD 1-9 (32 ROWS) IN FIRST SCAN |
| HEAD 1-10 (32 ROWS) IN FIRST SCAN |

| |
|---|
| HEAD 2-1 (32 ROWS) IN FIRST SCAN |
| HEAD 2-2 (32 ROWS) IN FIRST SCAN |
| HEAD 2-3 (32 ROWS) IN FIRST SCAN |
| HEAD 2-4 (32 ROWS) IN FIRST SCAN |
| HEAD 2-5 (32 ROWS) IN FIRST SCAN |
| HEAD 2-6 (32 ROWS) IN SECOND SCAN |
| HEAD 2-7 (32 ROWS) IN SECOND SCAN |
| HEAD 2-8 (32 ROWS) IN SECOND SCAN |
| HEAD 2-9 (32 ROWS) IN SECOND SCAN |
| HEAD 2-10 (32 ROWS) IN SECOND SCAN |

| |
|---|
| HEAD 3-1 (32 ROWS) IN SECOND SCAN |
| HEAD 3-2 (32 ROWS) IN SECOND SCAN |
| HEAD 3-3 (32 ROWS) IN SECOND SCAN |
| HEAD 3-4 (32 ROWS) IN SECOND SCAN |
| HEAD 3-5 (32 ROWS) IN SECOND SCAN |
| HEAD 3-6 (32 ROWS) IN SECOND SCAN |
| HEAD 3-7 (32 ROWS) IN SECOND SCAN |
| HEAD 3-8 (32 ROWS) IN SECOND SCAN |
| HEAD 3-9 (32 ROWS) IN SECOND SCAN |
| HEAD 3-10 (32 ROWS) IN SECOND SCAN |

LIQUID DISCHARGE APPARATUS AND LIQUID DISCHARGE METHOD

CROSS-REFERENCE TO RELATED APPLICATION

This patent application is based on and claims priority pursuant to 35 U.S.C. § 119(a to Japanese Patent Application No. 2018-144619, filed on Jul. 31, 2018, and No. 2019-114058, filed on Jun. 19, 2019 in the Japan Patent Office, the entire disclosure of which is hereby incorporated by reference herein.

BACKGROUND

Technical Field

Aspects of the present disclosure relate to a liquid discharge apparatus and a liquid discharge method.

Related Art

An inkjet-type image forming apparatus detects a non-discharge nozzle of a head and performs cleaning or correcting operation. For example, a technique is known that reads a printed nozzle-check pattern with an image sensor to specify the position of a non-discharge nozzle.

SUMMARY

In an aspect of the present disclosure, there is provided a liquid discharge apparatus that includes a liquid discharge head, a scanning device, a conveyance device, a reading device, control circuitry, and a detecting device. The liquid discharge head is configured to discharge liquid to a target object. The scanning device is configured to move the liquid discharge head in a main scanning direction. The conveyance device is configured to convey the target object in a direction perpendicular to the main scanning direction. The reading device is disposed at a predetermined position with respect to the liquid discharge head. The control circuitry is configured to change a detection pattern image for detecting a defective nozzle, in accordance with a feed amount of the target object in the sub-scanning direction. The detecting device is configured to identify a nozzle corresponding to a defective portion of the detection pattern image read by the reading device.

In another aspect of the present disclosure, there is provided a liquid discharge method for a liquid discharge apparatus including a liquid discharge head configured to discharge liquid to a target object, a scanning device configured to move the liquid discharge head in a main scanning direction, and a conveyance device configured to convey the target object in a direction perpendicular to the main scanning direction. The method includes changing a detection pattern image for detecting a defective nozzle, in accordance with a feed amount of the target object in the sub-scanning direction; reading the detection pattern image with a reading device disposed at a predetermined position with respect to the liquid discharge head; and identifying a nozzle corresponding to a defective portion of the detection pattern image read by the reading device.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 12 is an illustration of the recording heads and nozzle rows used to print non-discharge detection patterns by two sub-scanning feeds;

Figure 1:
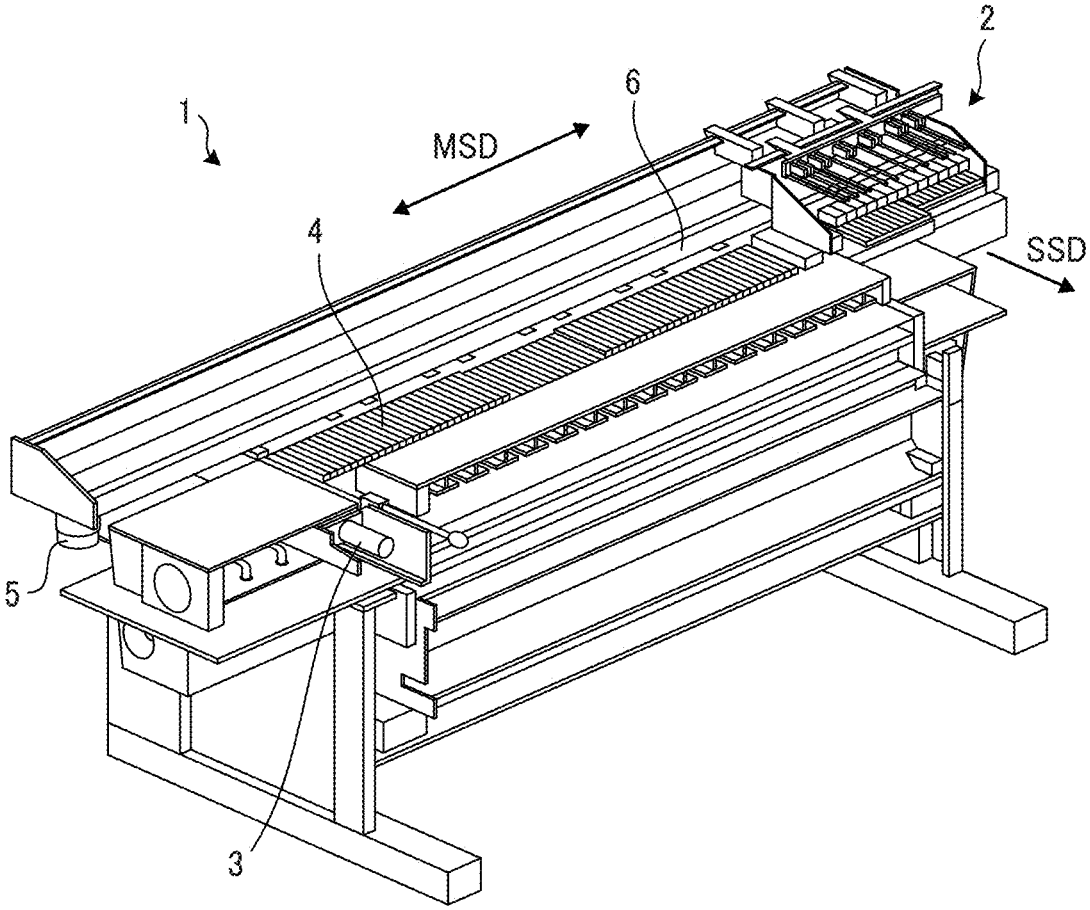
FIG. 1 is a perspective view of an external configuration of an inkjet printer.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, embodiments of the present disclosure will be described with reference to the attached drawings. In the present specification and drawings, constituent elements having substantially the same functional configurations are denoted by the same reference numerals to omit redundant description.

Embodiments of the present disclosure are described below with reference to the attached drawings. Referring now to the drawings, wherein like reference numerals designate identical or corresponding parts throughout the several views thereof, an image forming apparatus according to an embodiment of the present disclosure is described.

Hereinafter, an inkjet printer is described as an example of a liquid discharge apparatus according to an embodiment of the present disclosure.

External Configuration of Inkjet Printer FIG. 1 is a perspective view of an external configuration of an inkjet printer 1 according to an embodiment of the present disclosure. An ink carriage 2 is provided with a plurality of inkjet recording heads 41. A sub-scanning motor 3 is driven to intermittently feed a sheet to be printed (an example of a target object) on the platen 4. That is, the sheet is fed in a sub-scanning direction indicated by arrow SSD in FIG. 1. With the sheet being stopped, the ink carriage 2 discharges ink from the plurality of inkjet recording heads 41 while the main scanning motor 5 drives the ink carriage 2 to move back and forth in a traverse direction, which is a main scanning direction indicated by arrow MSD in FIG. 1, along a guide rod 6. Thus, an image is formed on the sheet.

Figure 2:
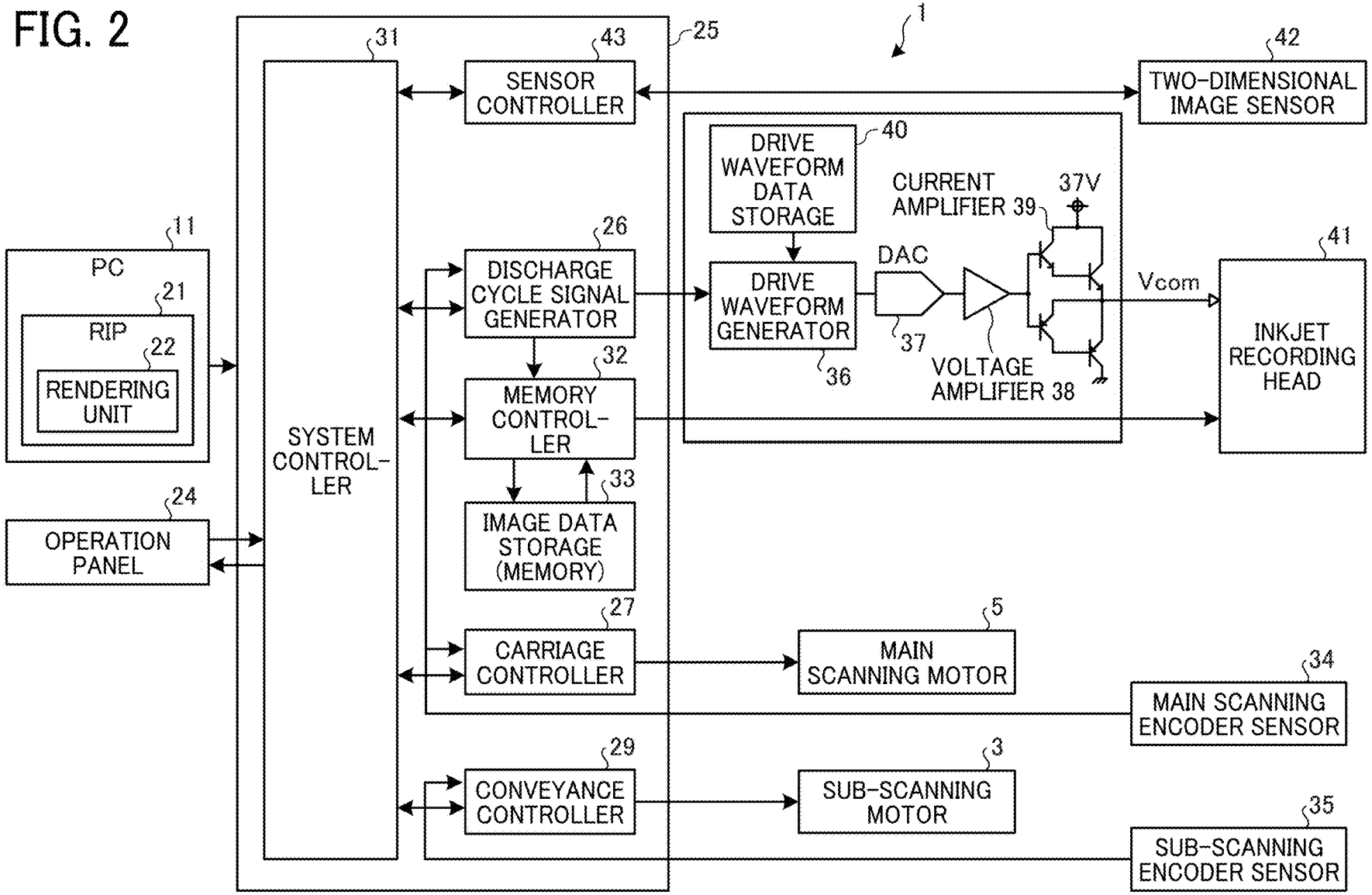
FIG. 2 is a block diagram of a hardware configuration of the inkjet printer.

Hardware Configuration of Inkjet Printer FIG. 2 is a block diagram of a hardware configuration of the inkjet printer 1. As illustrated in FIG. 2, the inkjet printer 1 is connected to a personal computer (PC) 11 for a user to input an image to be printed and select a print mode. The PC 11 stores a raster image processor (RIP) unit 21 that is a so-called driver to control image processing in accordance with a color profile or a setting of the user. The RIP unit 21 includes a rendering unit 22 that decomposes image data into image data for each scan.

The inkjet printer 1 includes a system controller 31 as circuitry and an image data storage 33 as a memory. The system controller 31 controls printing of image data received from the PC 11 based on an instruction transmitted from the PC 11 or an operation panel 24. The image data storage 33 temporarily stores the image data transmitted from the PC 11. The RIP unit 21 and the rendering unit 22 stored in the PC 11 may be stored in the system controller 31.

An image forming program is stored in the image data storage 33 (or may be stored in another storage). The system controller 31 operates based on the image forming program to control detection and recovery of non-discharge nozzles described later.

The inkjet printer 1 further includes a memory controller 32 that controls the image data storage 33 and transfers image data to the inkjet recording heads 41 (hereinafter simply, referred to as the recording heads 41). The inkjet printer 1 includes a discharge cycle signal generator 26 and a carriage controller 27. The discharge cycle signal generator 26 generates a discharge cycle signal from an output signal of a main scanning encoder sensor 34 and a resolution set by the user. The carriage controller 27 calculates position information of the ink carriage 2 from the output signal of the main scanning encoder sensor 34 to control the main scanning motor 5.

The inkjet printer 1 includes a conveyance controller 29 and a sensor controller 43. The conveyance controller 29 calculates position information of media conveyance from an output signal of the sub-scanning encoder sensor 35 to control the sub-scanning motor 3. The sensor controller 43 controls a two-dimensional image sensor 42 (an example of a reading device) to capture image data, acquires the image data, and performs arithmetic processing on the image data acquired. The inkjet printer 1 includes a controller board 25. The controller board 25 includes the system controller 31, the image data storage 33, the memory controller 32, the discharge cycle signal generator 26, the carriage controller 27, the conveyance controller 29, and the sensor controller 43.

The inkjet printer 1 includes a drive waveform data storage 40 and a drive waveform generator 36. The drive waveform data storage 40 stores a drive waveform for driving the recording head 41. The drive waveform generator 36 outputs drive waveform data read out from the drive waveform data storage 40 to a digital-to-analog (D/A) converter 37 with a discharge cycle signal as a trigger. The inkjet printer 1 further includes the D/A converter 37, a voltage amplifier 38, and a current amplifier 3. The D/A converter 37 converts drive waveform data into analog data. The voltage amplifier 38 amplifies the voltage of the analog data. The current amplifier 39 amplifies the current.

The inkjet printer 1 includes the current amplifier 39 and the recording head 41 that is driven and controlled by the drive waveform. The system controller 31 adds a non-discharge detection pattern, which is an example of a detection pattern, to the image data in accordance with an instruction from the rendering unit 22 of the PC 11, and the image data is decomposed into image data for each scan. Alternatively, after the image data is decomposed into image data for each scan, a non-discharge detection pattern for each scan may be added. The system controller 31 is an example of a detection pattern adder.

The system controller 31, the carriage controller 27, the main scanning motor 5, the main scanning encoder sensor 34, and the like are an example of a scanning device. The system controller 31, the conveyance controller 29, the sub-scanning motor 3, the sub-scanning encoder sensor 35, and the like are an example of a conveyance device.

Configuration of Two-Dimensional Image Sensor and Sensor Controller

Figure 3:
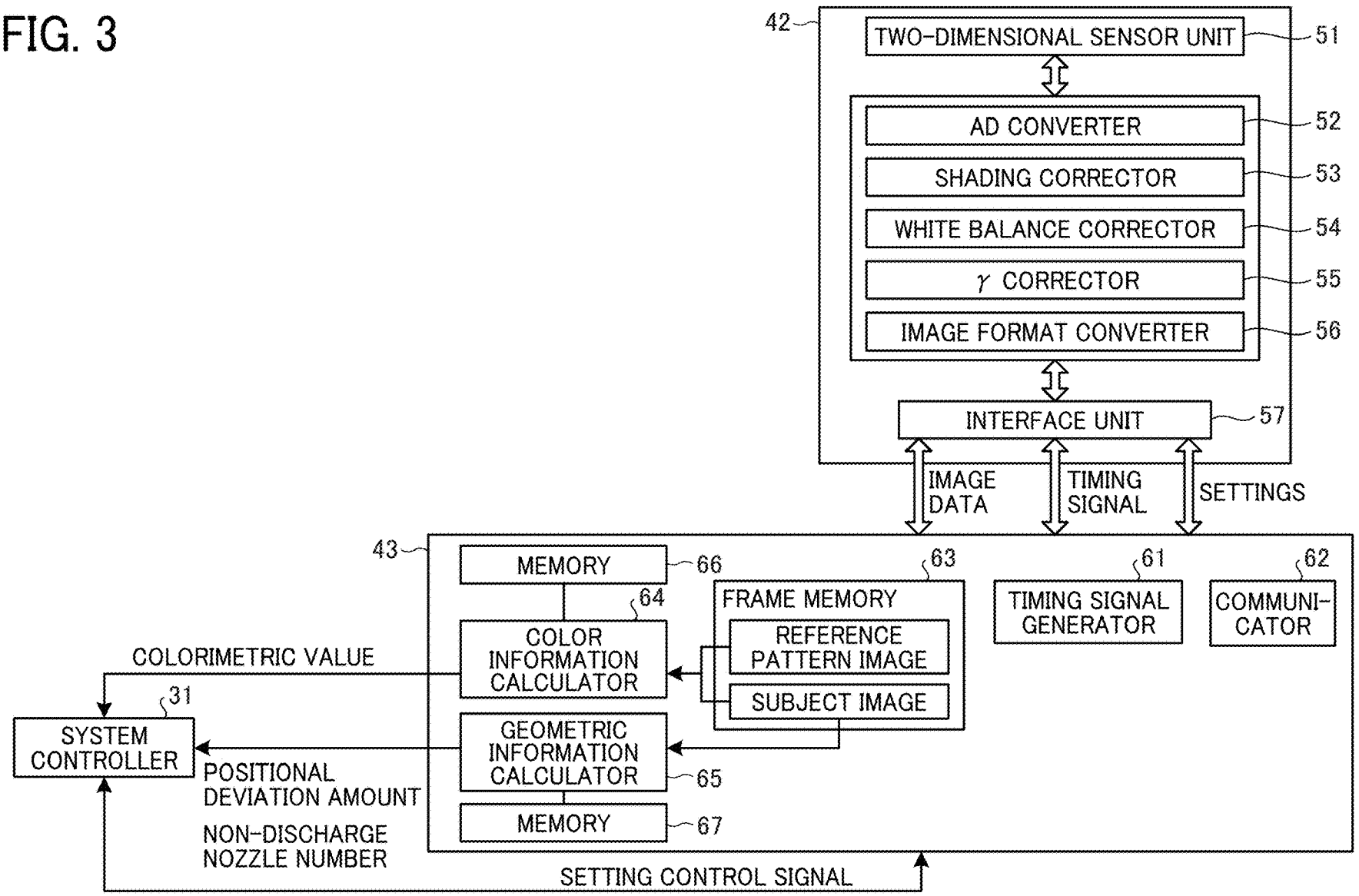
FIG. 3 is a block diagram of a two-dimensional image sensor and a sensor controller.

FIG. 3 is a block diagram of the two-dimensional image sensor 42 and the sensor controller 43. The two-dimensional image sensor 42 is a complementary metal oxide semiconductor (CMOS) image sensor and includes an analog-to-digital (AD) converter 52 and a shading corrector 53. The AD converter 52 performs analog-to-digital conversion on an analog signal from the two-dimensional sensor unit 51. The shading corrector 53 corrects variations of pixel sensitivity and uneven lighting. The two-dimensional image sensor 42 includes a white balance corrector 54 to correct light amount fluctuations of lighting, a y corrector 55 to compensate for the linearity of sensitivity, and an image format converter 56 to convert digital image data into an arbitrary image format. The two-dimensional image sensor 42 includes an interface unit for input and output of image data, timing signals, various setting signals, and the like with external devices.

The sensor controller 43 has a drive signal generation function and an arithmetic processing function. The sensor controller 43 includes a timing generator 61 to generate a timing signal for driving the two-dimensional image sensor 42 and a communication unit 62 to set an operation mode of the two-dimensional image sensor 42 and the like.

The sensor controller 43 further includes a frame memory 63 to store subject image data (a subject image) of a non-discharge detection pattern received from the two-dimensional image sensor 42. In the frame memory 63, a reference pattern image is stored together with the subject image of the non-discharge detection pattern. The reference pattern image and the subject image of the non-discharge detection pattern are supplied to a color information calculator 64. The subject image of the non-discharge detection pattern is supplied to a geometric information calculator 65.

The color information calculator 64 computes a colorimetric value based on the reference pattern image, the subject image of the non-discharge detection pattern, and the reference value stored in a memory 66, and supplies the colorimetric value to the system controller 31 corresponding to a host CPU.

The geometric information calculator 65 compares the subject image of the non-discharge detection pattern with an image of the non-discharge detection pattern serving as a reference stored in a memory 67 to detect the nozzle number (non-discharge nozzle number) of a non-discharge nozzle corresponding to a defective portion of the non-discharge detection pattern and notifies the system controller 31 of the non-discharge nozzle number. The system controller 31 controls driving of the recording head 41 to compensate the image formed by the non-discharge nozzle notified by the non-discharge nozzle number with another head or nozzle.

Alternatively, the system controller 31 performs a recovery operation of controlling discharge of the nozzle of the notified non-discharge nozzle number, for example, for a predetermined time period or a predetermined number of times. After the system controller 31 performs such recovery operation, the geometric information calculator 65, which is an example of a detecting device, compares again the subject image of the non-discharge detection pattern with the image of the non-discharge detection pattern serving as the reference stored in the memory 67 to detect the nozzle number (non-discharge nozzle number) of the non-discharge nozzle corresponding to the defective portion of the non-discharge detection pattern and notifies the non-discharge nozzle number to the system controller 31. The system controller 31 determines whether the nozzle on which the recovery operation has been performed has recovered, based on the non-discharge nozzle number notified from the geometric information calculator 65. Such a configuration can prevent generation of an abnormal image, such as a print image including white stripes generated due to non-discharge.

The system controller 31 supplies various setting control signals for setting the timing, conditions, and the like of imaging to the sensor controller 43. In the present embodiment, the sensor controller 43 performs colorimetric operation and geometric operation. In some embodiments, the system controller 31 corresponding to the host CPU may perform operation with reference to an image in the frame memory 63.

Figure 4:
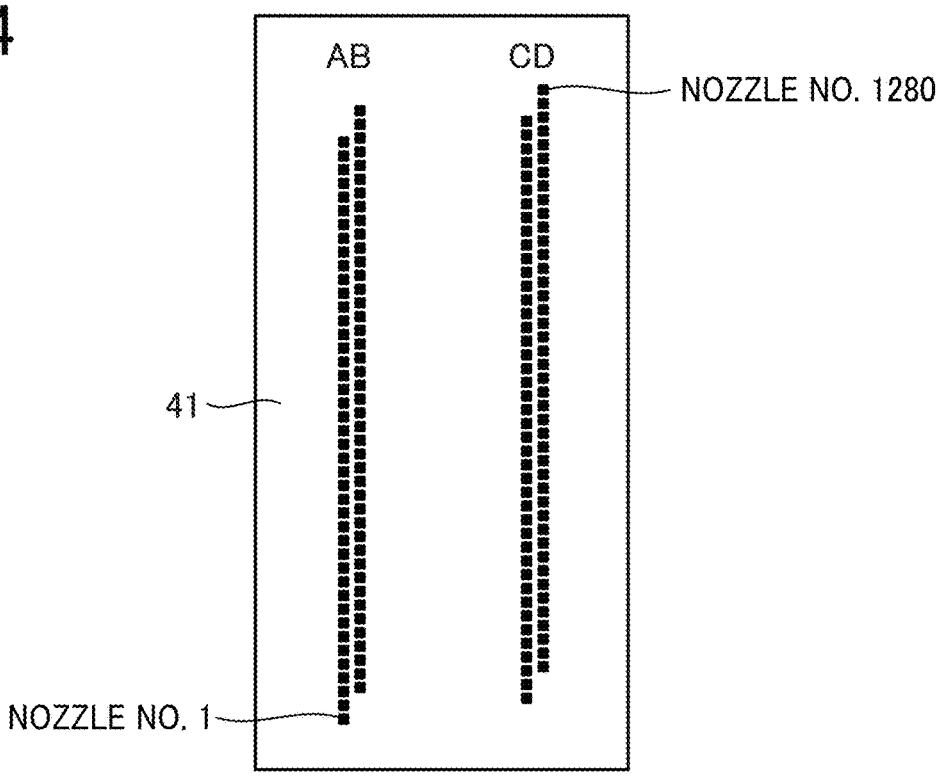
FIG. 4 is an illustration of an example of the structure of a recording head.

Structure of Recording Head FIG. 4 is an illustration of an example of the structure of the recording head 41. The recording head 41 illustrated in FIG. 4 includes four nozzle rows A to D as an example. The number of nozzles per row is 320 nozzles. In the case of the four nozzle rows A to D, the total number of nozzles of one head is 1280. The nozzles may cause discharge failure during use. By detecting which nozzle is a defective nozzle, processing such as compensating for an image formed by the defective nozzle with another head or nozzle can be performed.

Figure 5:
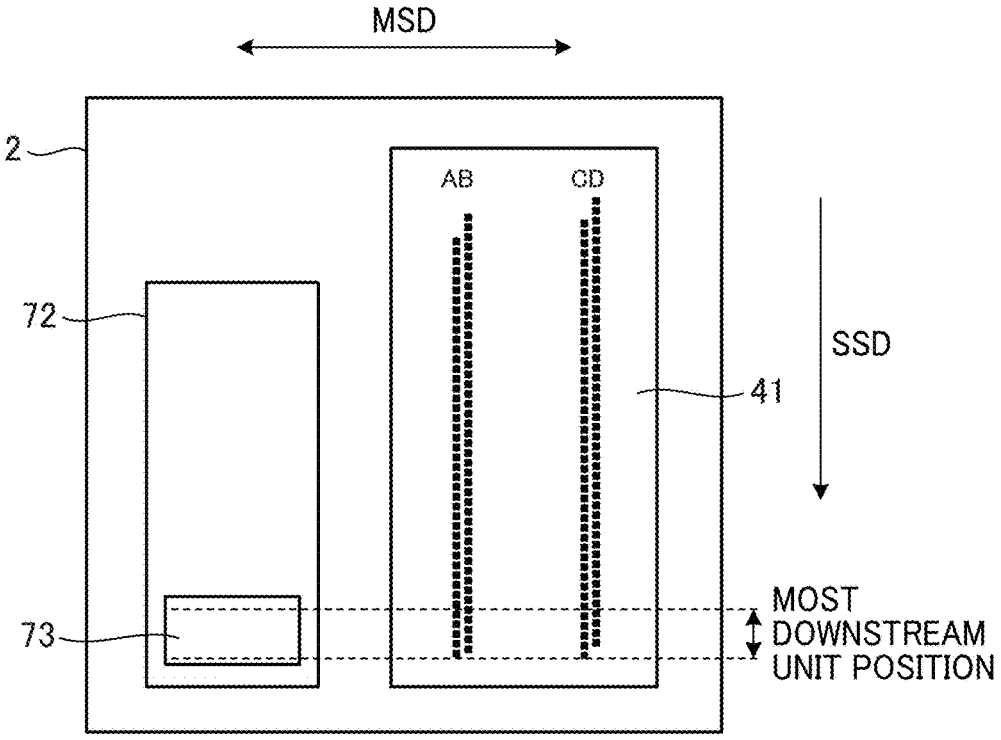
FIG. 5 is an illustration of an example of the relation between the nozzle position of the recording head and the mounting position of the two-dimensional sensor unit.

Relation between Nozzle Position of Recording Head and Sensor Mounting Position FIG. 5 is an illustration of an example of the relation between the nozzle position of the recording head 41 and the mounting position of the two-dimensional sensor unit 72. As illustrated in FIG. 5, the two-dimensional sensor unit 72 is provided with the above-described two-dimensional image sensor 42 and a sensor lens 73. Although this is one example, as the non-discharge detection pattern readable by the two-dimensional image sensor 42 via the sensor lens 73, the non-discharge detection pattern corresponding to the nozzles for 32 rows can be read.

For example, in a configuration in which the head nozzles are positioned downstream from the imaging range of the two-dimensional image sensor 42 in the sub-scanning direction SSD, it would be necessary to perform conveyance control to return the sheet once and read the non-discharge detection pattern.

However, for the liquid discharge apparatus according to the present embodiment, the two-dimensional image sensor 42 and the recording head 41 are mounted on the ink carriage so that the sensor lens 73 is at the same position as the most downstream unit position of the recording head 41 (the position of nozzles for 32 rows to print the non-discharge detection pattern). Such a configuration allows reading of the non-discharge detection pattern without returning the sheet. That is, aligning the mounting position of the two-dimensional image sensor 42 with an end of the recording head 41 in the sub-scanning direction allows reading of the non-discharge detection pattern while reducing unnecessary scanning. In other words, mounting the two-dimensional image sensor 42 in alignment with the end of the recording head 41 allows reading of the non-discharge detection pattern while reducing unnecessary scanning.

That is, for the inkjet printer 1 according to the present embodiment, the size of the two-dimensional image sensor 42 is not a size capable of reading non-discharge detection patterns printed by all nozzles of the recording head 41 but a size capable of reading non-discharge detection patterns printed by the nozzles (a part of the nozzles) of 32 rows of the recording head 41. In other words, the positions and the number of the nozzles used for printing the non-discharge detection pattern are determined by the feed amount of the sheet in the sub-scanning direction and the size of the reading area of the two-dimensional image sensor 42.

Head Configuration with Three Recording Heads

Figure 6:
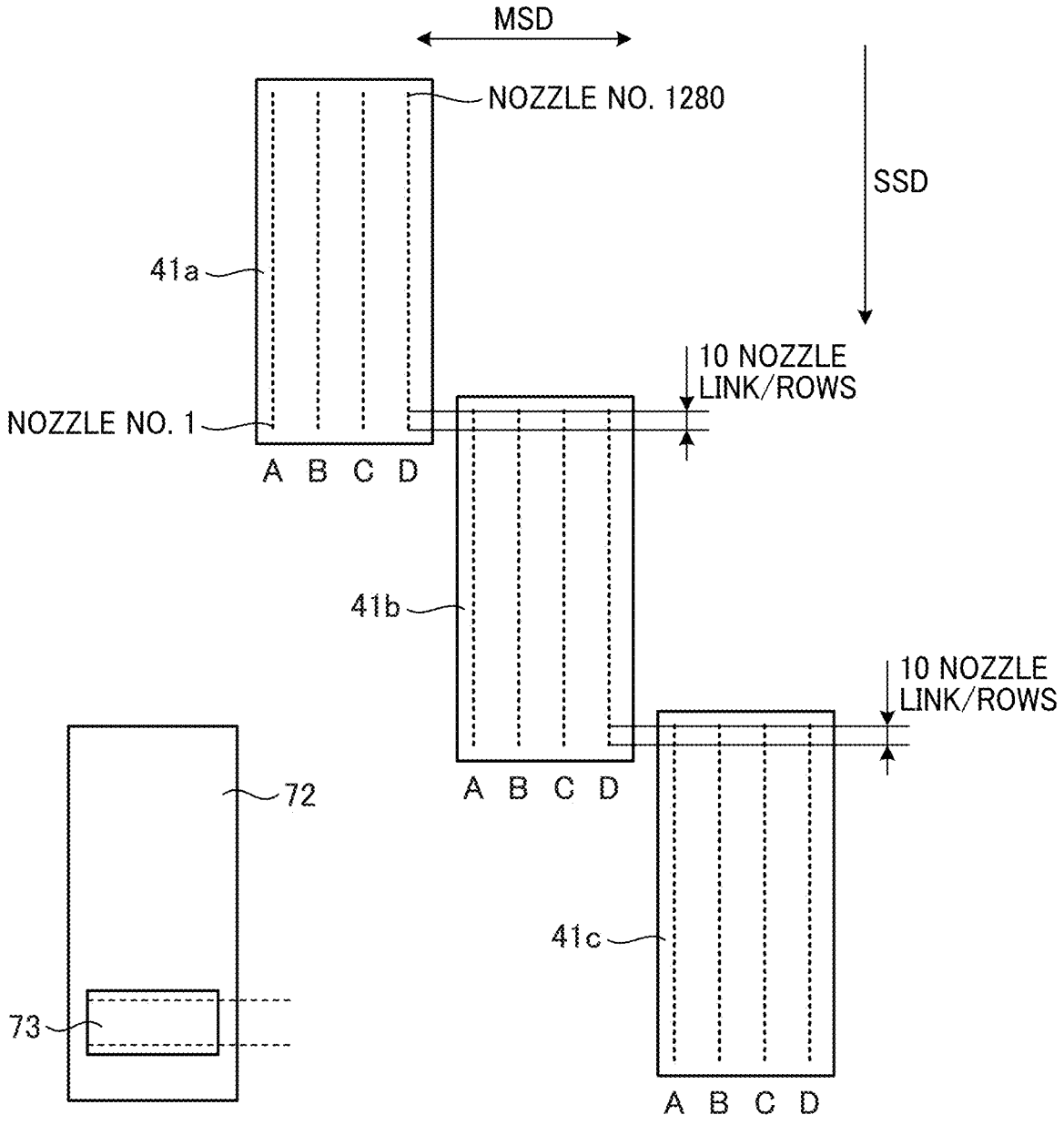
FIG. 6 is an illustration of a head configuration of three recording heads.

FIG. 6 is an illustration of a head configuration of three recording heads 41*a* to 41*c*. FIG. 6 is a perspective view of the ink carriage 2 as viewed from the nozzle surface side. Table 1 below presents the printing mode and the number of times of sub-scanning feeds for forming an image in an image forming width of the recording head.

TABLE 1

| | (a) Number of interlaces: Number of times of sub-scanning feeds for forming image in an image forming width of head | (b) 940 nozzles/ number of interlaces | Maximum number of nozzles readable by image captured by two-dimensional image sensor is 32 rows and quotient of (b) |
|---|---|---|---|
| First print mode | 2 | 470 | 15 with remainder 0 rows |

TABLE 1-continued

| | (a) Number of interlaces: Number of times of sub-scanning feeds for forming image in an image forming width of head | (b) 940 nozzles/ number of interlaces (b) | Maximum number of nozzles readable by image captured by two-dimensional image sensor is 32 rows and quotient of |
|---|---|---|---|
| Second print mode | 4 | 235 | 15 with remainder 11 rows |

The inkjet printer 1 according to the present embodiment forms a non-discharge detection pattern in a region other than a print image region while forming a print image (during a print job). At this time, the inkjet printer 1 forms the non-discharge detection pattern in accordance with the amount of sub-scanning feed (which changes depending on the number of interlaces) of the print mode of the print image, thus allowing efficient formation of the non-discharge detection pattern.

For example, in the case of the three-head configuration with the three recording heads 41*a* to 41*c*, there are 320 nozzles×3 heads, that is, the total of 960 nozzles along the sub-scanning direction. The non-discharge detection pattern is formed with the number of sub-scanning feeds (that is, the number of interlaces) for forming a print image for the image formation width by the 960 nozzles.

However, in the case in which the two-dimensional image sensor 42 can read, for example, an image corresponding to a maximum of 32 rows of nozzles, all non-discharge detection patterns may be exactly formed by the number of times of formation operations corresponding to the number of sub-scanning feeds, depending on the print mode of the print image. On the other hand, an extra row of the non-discharge detection pattern may occur. When the extra row occurs depending on the printing mode, the inkjet printer 1 according to the present embodiment forms the non-discharge detection pattern of the extra row together with the non-discharge detection pattern formed by the nozzles for 32 rows, thus allowing efficient pattern formation.

Specifically, as illustrated in FIG. 6, ten nozzles serving as a link between the recording head 41*a* and the recording head 41*b* and ten nozzles serving as a link between the recording head 41*b* and the recording head 41*c* are subtracted from the total of 960 nozzles described above to obtain 940 nozzles. In a first printing mode illustrated in Table 1, the number of interlaces is two and the 940 nozzles described above are divided by two as the number of interlaces to obtain 470. Then, when the number 470 is divided by 32 rows, the quotient becomes 15 and the remainder becomes 0. In this case, no extra rows occur.

However, in a second print mode illustrated in Table 1, the number of interlaces is four and the 940 nozzles described above are divided by four as the number of interlaces to obtain 235. Then, when the number 235 is divided by 32 rows, the quotient becomes 7 and the remainder becomes 11. Accordingly, 11 extra rows occur. In this case, a non-discharge detection pattern of 32 rows and a non-discharge detection pattern of the extra rows are respectively formed. Thus, the non-discharge detection pattern can be efficiently formed.

Figures 7A, 7B:
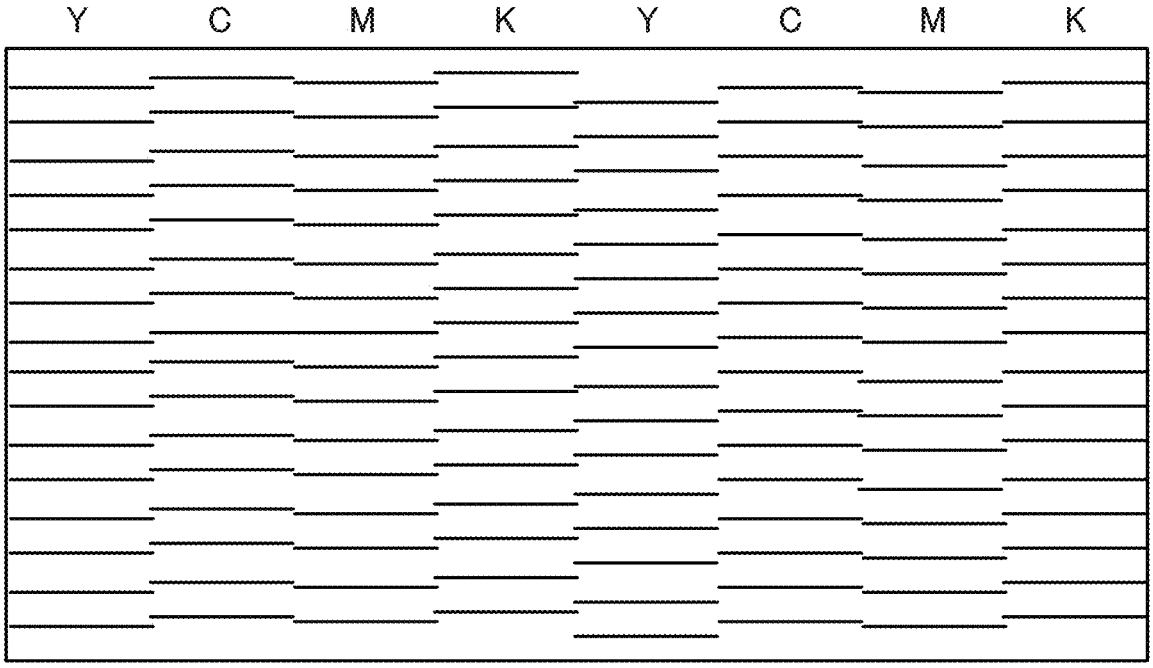
FIGS. 7A and 7B are diagrams of the relation between non-discharge detection pattern and nozzle position.

Example of Non-Discharge Detection Pattern FIGS. 7A and 7B are diagrams of the relation between the non-discharge detection pattern and the nozzle position. FIG. 7A is an illustration of an example of the non-discharge detection pattern (32-row pattern) of 32 rows. FIG. 7B is a table of the nozzle numbers of nozzles used for printing the 32-row pattern. As an example, as illustrated in FIG. 7A, the non-discharge detection pattern includes a row of non-discharge detection pattern printed in yellow (Y), a row of non-discharge detection pattern printed in cyan (C), a row of non-discharge detection pattern printed in magenta (M), a row of non-discharge detection pattern printed in the black (K), another row of non-discharge detection pattern printed in yellow (Y), another row of non-discharge detection pattern printed in cyan (C), another row of non-discharge detection pattern printed in magenta (M), and another row of non-discharge detection pattern printed in the black (K).

The yellow (Y) row of the non-discharge detection pattern at the left end of FIG. 7A is printed by the nozzle with the nozzle number 5, the nozzle with the nozzle number 13, the nozzle with the nozzle number 21 . . . the nozzle with the nozzle number 117, and the nozzle with the nozzle number 125. The cyan (C) row of the non-discharge detection pattern adjacent to the yellow (Y) row at the left end of FIG. 7A is printed by the nozzle with the nozzle number 7, the nozzle with the nozzle number 15, the nozzle with the nozzle number 23 the nozzle with the nozzle number 119, and the nozzle with the nozzle number 127. The magenta (M) row of the non-discharge detection pattern, which is the third row from the left end of FIG. 7A, is printed by the nozzle with the nozzle number 6, the nozzle with the nozzle number 14, the nozzle with the nozzle number 22 the nozzle with the nozzle number 118, and the nozzle with the nozzle number 126. The black (K) row of the non-discharge detection pattern, which is the fourth row from the left end of FIG. 7A, is printed by the nozzle with the nozzle number 8, the nozzle with the nozzle number 16, the nozzle with the nozzle number the nozzle with the nozzle number 122, and the nozzle with the nozzle number 128.

The black (K) row of the non-discharge detection pattern at the right end of FIG. 7A is printed by the nozzle with the nozzle number 4, the nozzle with the nozzle number 12, the nozzle with the nozzle number 20 . . . the nozzle with the nozzle number 116, and the nozzle with the nozzle number 124. The magenta (M) row of the non-discharge detection pattern adjacent to the black (K) row at the right end of FIG. 7A is printed by the nozzle with the nozzle number 2, the nozzle with the nozzle number 10, the nozzle with the nozzle number the nozzle with the nozzle number 114, and the nozzle with the nozzle number 122. The cyan (C) row of the non-discharge detection pattern, which is the third row from the right end of FIG. 7A, is printed by the nozzle with the nozzle number 3, the nozzle with the nozzle number 11, the nozzle with the nozzle number 19 . . . the nozzle with the nozzle number 115, and the nozzle with the nozzle number 123. The yellow (Y) row of the non-discharge detection pattern, which is the fourth row from the right end of FIG. 7A, is printed by the nozzle with the nozzle number 1, the nozzle with the nozzle number 9, the nozzle with the nozzle number 17 . . . the nozzle with the nozzle number 113, and the nozzle with the nozzle number 121.

Figure 8:
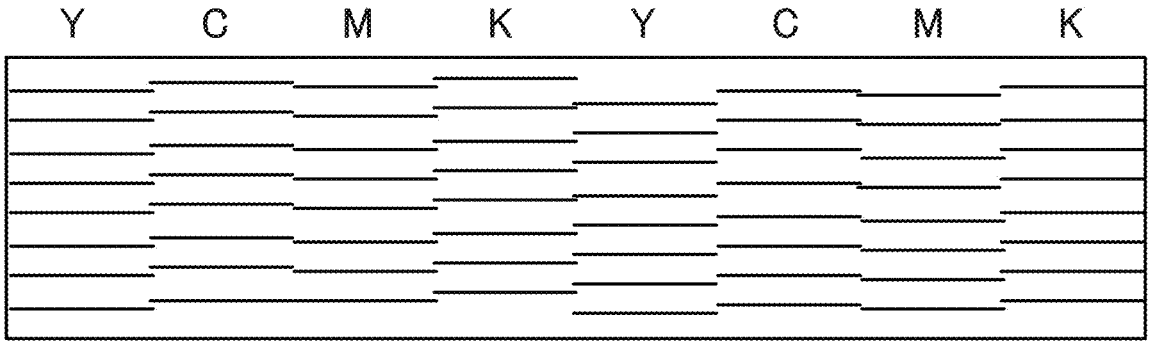
FIG. 8 is an illustration of a 16-row pattern as an example of non-discharge detection pattern.
Figure 9:
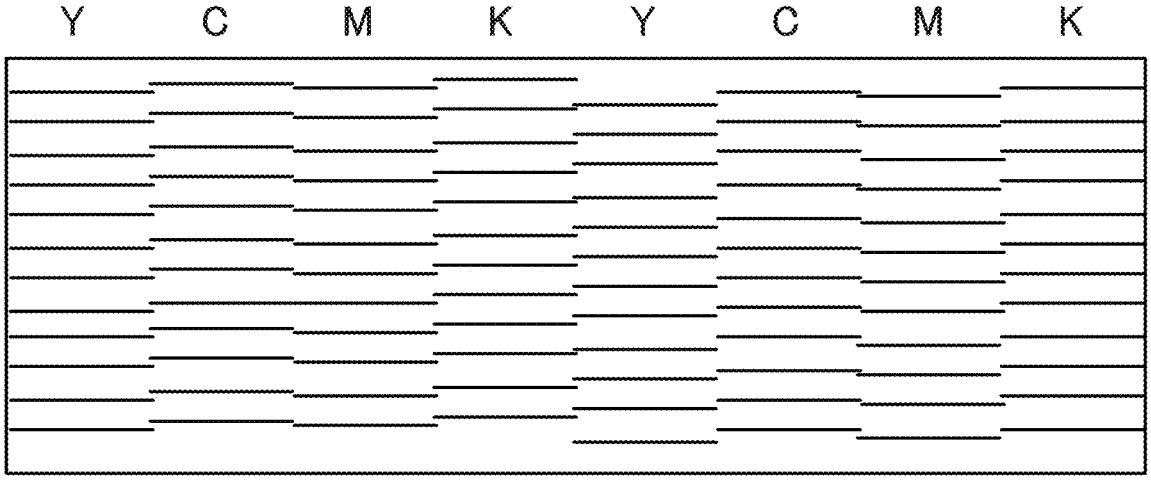
FIG. 9 is an illustration of a 24-row pattern as an example of non-discharge detection pattern.

FIG. 8 is an illustration of a 16-row pattern as an example of the non-discharge detection pattern. FIG. 9 is an illustration of a 24-row pattern as an example of the non-discharge detection pattern.

Although it is an example, in the case of the inkjet printer 1 according to the present embodiment, the non-discharge detection pattern is formed by reference lines having four corners or four sides. Thus, the nozzle position can be identified without being affected by a change in magnification due to variations in the distance between the sheet and the two-dimensional image sensor 42.

Print Operation of Non-Discharge Detection Pattern

Case of Forming Pattern by Two Sub-Scanning Feeds

Figure 10:
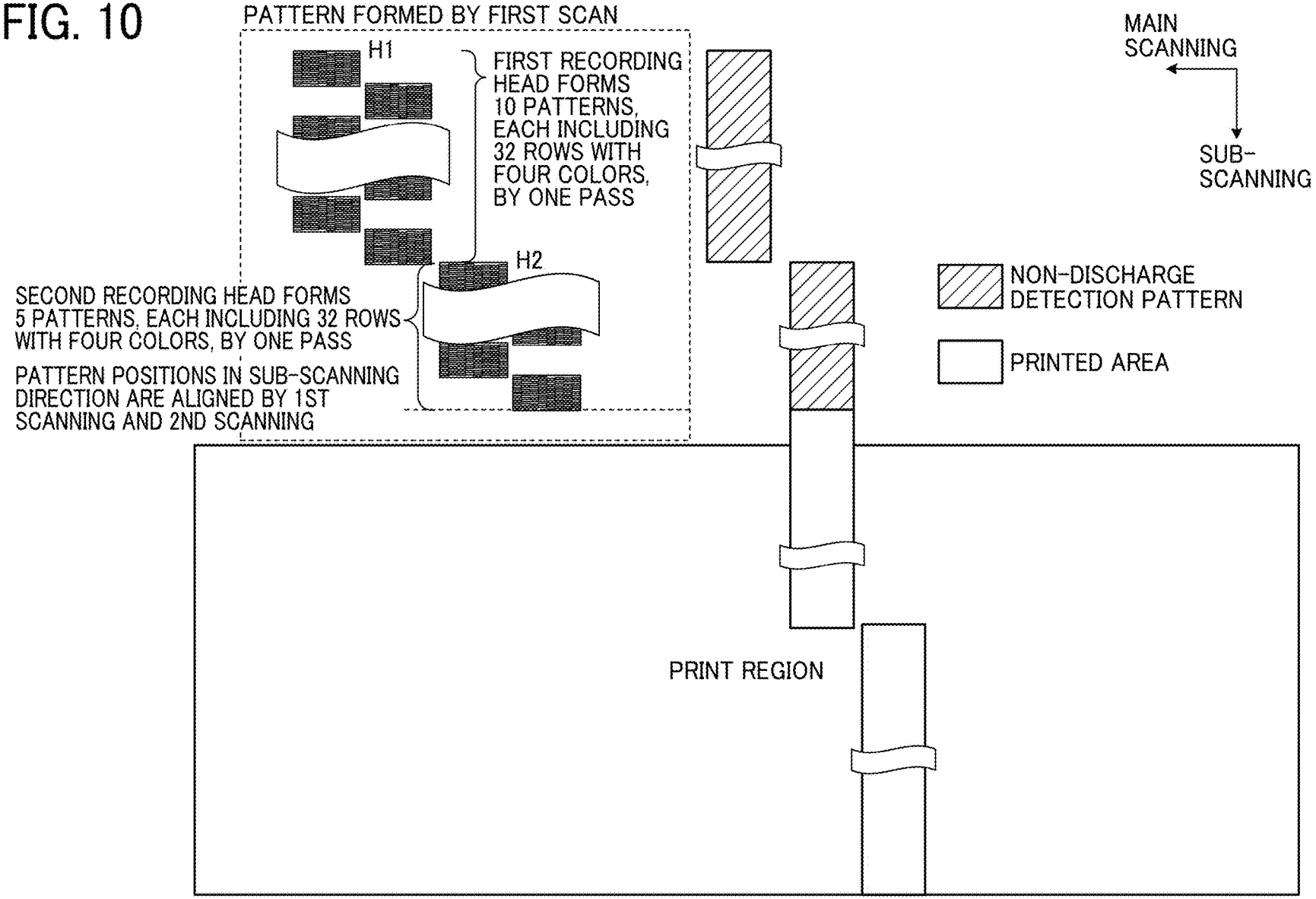
FIG. 10 is an illustration of an example in which non-discharge detection patterns are formed by two sub-scanning feeds (in a first print mode) by three recording heads, depicting non-discharge detection patterns formed by a first scan.
Figure 11:
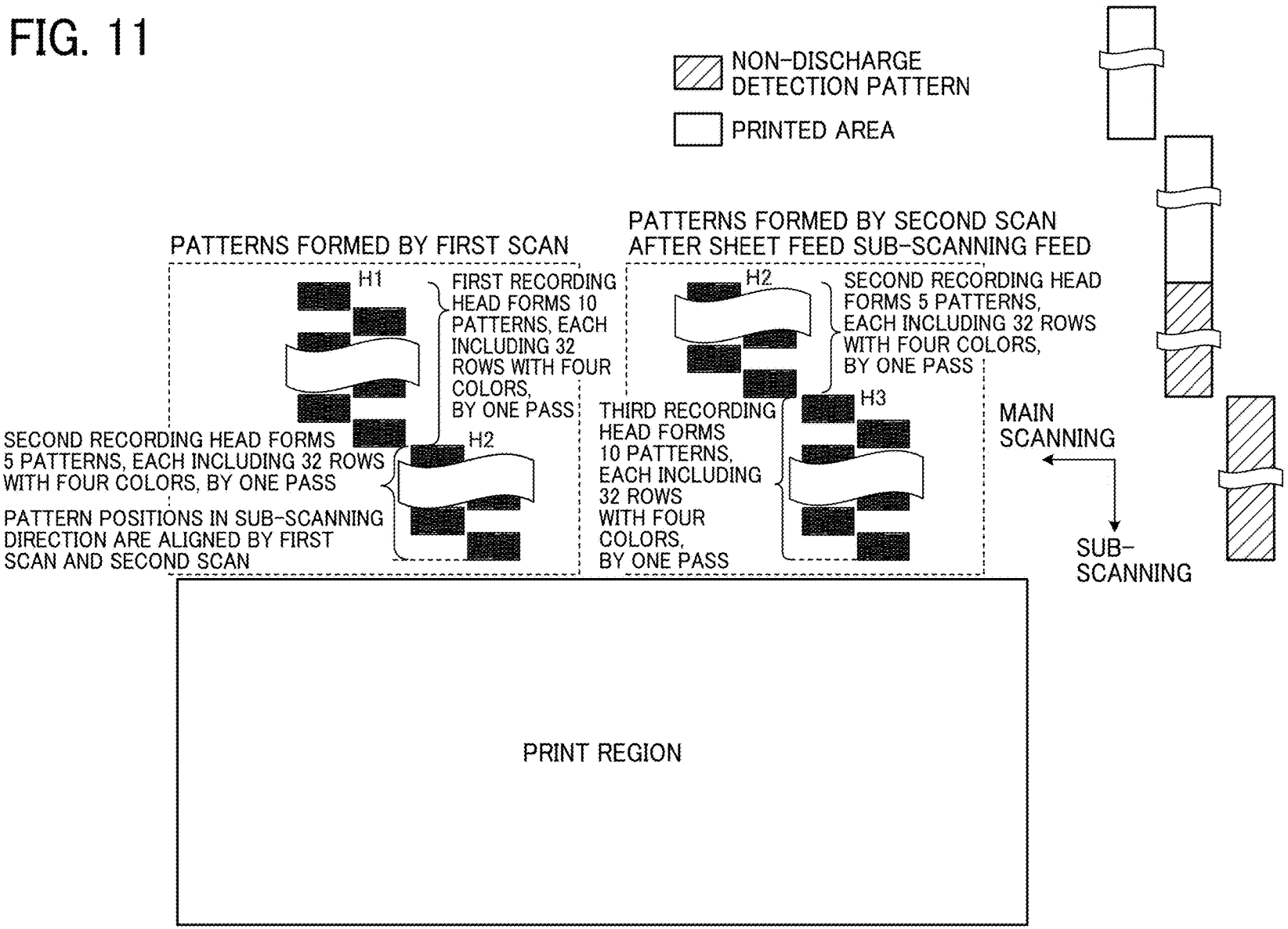
FIG. 11 is an illustration of an example in which non-discharge detection patterns are formed by two sub-scanning feeds (in the first print mode) by three recording heads, depicting non-discharge detection patterns formed by a second scan after a sub-scanning feed.

FIGS. 10 and 11 are illustrations of an example in which a non-discharge detection pattern is formed by two sub-scanning feeds (in a first print mode) by three recording heads. FIG. 10 is an illustration of non-discharge detection patterns formed in the first scan. FIG. 11 is an illustration of non-discharge detection patterns formed in the second scan after a sub-scanning teed. The print region illustrated in FIGS. 10 and 11 and the print region described in the present disclosure each indicate a region in which an image designated by a user or the like is to be printed. The non-discharge detection pattern is printed in a region other than the print region. In the example of FIGS. 10 and 11, non-discharge detection patterns in a dotted frame on the left side of FIGS. 10 and 11 are formed in the first scan by the three recording heads 41*a* to 41*c*. After a sub-scanning feed, non-discharge detection patterns in a dotted frame on the right side of FIG. 11 are formed in the second scan.

In the first scan, the system controller 31 causes the first recording head 41*a* to form ten non-discharge detection patterns of 32 rows×4 colors (YCMK) corresponding to the reading area of the two-dimensional image sensor 42 by one pass. The system controller 31 causes the second recording head 41*b* to form five non-discharge detection patterns of 32 rows×4 colors (YCMK) by one pass.

The system controller 31 causes the second recording head 41*b* to form five non-discharge detection patterns of 32 rows×4 colors (YCMK) by one pass in the second scan after sub-scanning feed. The system controller 31 further causes the third recording head 41*c* to form ten non-discharge detection patterns of 32 rows×4 colors (YCMK) by one pass.

In addition, since it is difficult to form a frame after the 32nd row (because it is difficult to subsequently print a non-discharge detection pattern), the system controller 31 controls, for example, the carriage controller 27, the main scanning motor 5, the first recording head 41*a*, and the second recording head 41*b* to print a non-discharge detection pattern at a position shifted by a distance corresponding to 32 rows in the main scanning direction.

The system controller 31 controls printing of non-discharge detection patterns in the first scan and the second scan so that the position of the non-discharge detection pattern in the first scan and the position of the non-discharge detection pattern in the second scan coincide with each other in the sub-scanning direction. That is, 15 non-discharge detection patterns in the first scan and 15 non-discharge detection patterns in the second scan are aligned with each other in the sub-scanning direction and are disposed at positions at which the two-dimensional image sensor 42 can read two patterns by one scan. In this example, 15 sub-scanning feeds and scans can complete the reading.

FIG. 12 is an illustration of the recording heads and nozzle rows used to print non-discharge detection patterns by two sub-scanning feeds. When non-discharge detection patterns are printed by two sub-scanning feeds, as illustrated in FIG. 12, heads 1-1 to 1-10 of the first recording head 41*a* and heads 2-1 to 2-5 of the second recording head 41*b*, each of which includes 32 rows of nozzles, are used in the first scan. In the second scan, heads 2-6 to 2-10 of the second recording head 41*b* of the second recording head 41*b* and heads 3-1 to 3-10 of the third recording head 41*c*, each of which includes 32 rows of nozzles, are used in the second scan.

Figure 13:
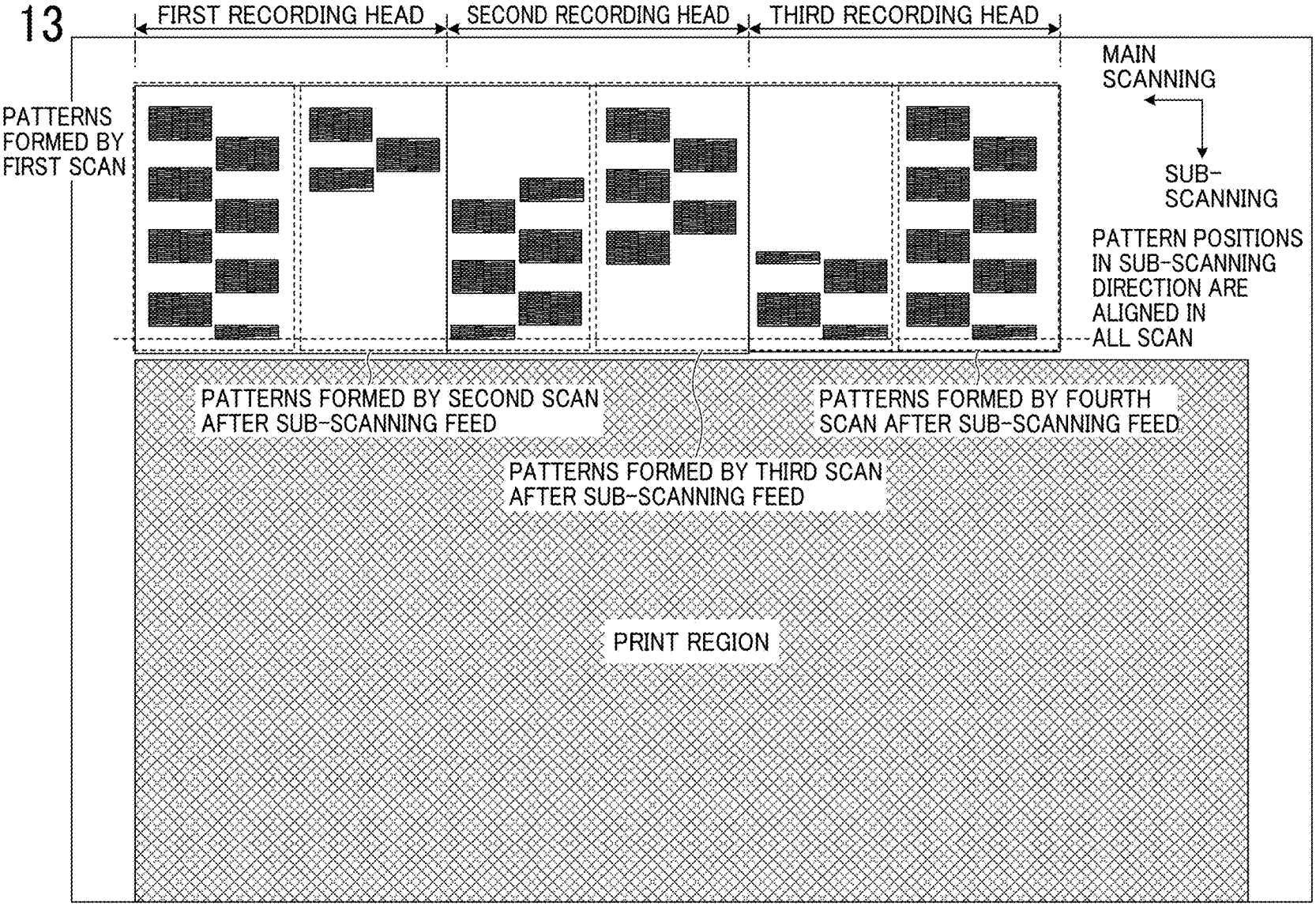
FIG. 13 is an illustration of an example in which non-discharge detection patterns are formed by four sub-scanning feeds (in a second print mode) by three recording heads.

Case of forming pattern by four sub-scanning feeds Next, FIG. 13 is an illustration of an example in which non-discharge detection patterns are formed by four sub-scanning feeds (in a second print mode) by three recording heads 41*a* to 41*c*. The print region illustrated in FIG. 13 is a region in which an image designated by the user or the like is to be printed. The non-discharge detection pattern is printed in a region other than the print region. In the example of FIG. 13, non-discharge detection patterns in a first dotted frame on the left side of FIG. 13 are formed in the first scan by the three recording heads 41*a* to 41*c*. After a sub-scanning feed, non-discharge detection patterns in a second dotted frame right next to the first dotted frame are formed in the second scan. After another sub-scanning feed, non-discharge detection patterns in a third dotted frame right next to the second dotted frame are formed in the third scan. After still another sub-scanning feed, non-discharge detection patterns in a fourth dotted frame right next to the third dotted frame are formed in the fourth scan.

In the first scan, the system controller 31 causes the first recording head 41*a* to form seven non-discharge detection patterns of 32 rows×4 colors (YCMK) and one non-discharge detection pattern of 11 rows×4 colors (YCMK) corresponding to the reading area of the two-dimensional image sensor 42 by one pass.

The system controller 31 causes the first recording head 41*a* to form two non-discharge detection patterns of 32 rows 4 colors (YCMK) and one non-discharge detection pattern of 21 rows×4 colors in the second scan after a sub-scanning feed. In the second scan, the system controller 31 causes the second recording head 41*b* to form one non-discharge detection pattern of 11 rows×4 colors (YCMK) and four non-discharge detection patterns of 32 rows×4 colors (YCMK), and one non-discharge detection pattern of 21 rows×4 colors (YCMK).

The system controller 31 also causes the second recording head 41*b* to form five non-discharge detection patterns of 32 rows×4 colors (YCMK) in the third scan after a sub-scanning feed. The system controller 31 causes the third recording head 41*c* to form one non-discharge detection pattern of 10 rows×4 colors (YCMK) and two non-discharge detection patterns of 32 rows×4 colors (YCMK), and one non-discharge detection pattern of 11 rows×4 colors (YCMK) in the third scan.

The system controller 31 causes the third recording head 41*c* to form seven non-discharge detection patterns of 32 rows×4 colors (YCMK) and one non-discharge detection pattern of 11 rows×4 colors (YCMK) in the fourth scan after a sub-scanning feed.

The non-discharge detection patterns formed in respective scans are aligned along the sub-scanning direction. The two-dimensional image sensor 42 can read a plurality of non-discharge detection patterns by one scan. In this example, eight sub-scanning feeds and scans complete the reading.

Non-discharge detection patterns are shifted for each head in the second scan and the third scan because pattern formation in an overlap area (10 nozzles) between heads may overlap between the heads or adjacent patterns of the same head. If the pattern formation do not overlap in the overlap area between heads, there is no need to shift non-discharge detection patterns for each head.

Figure 14:
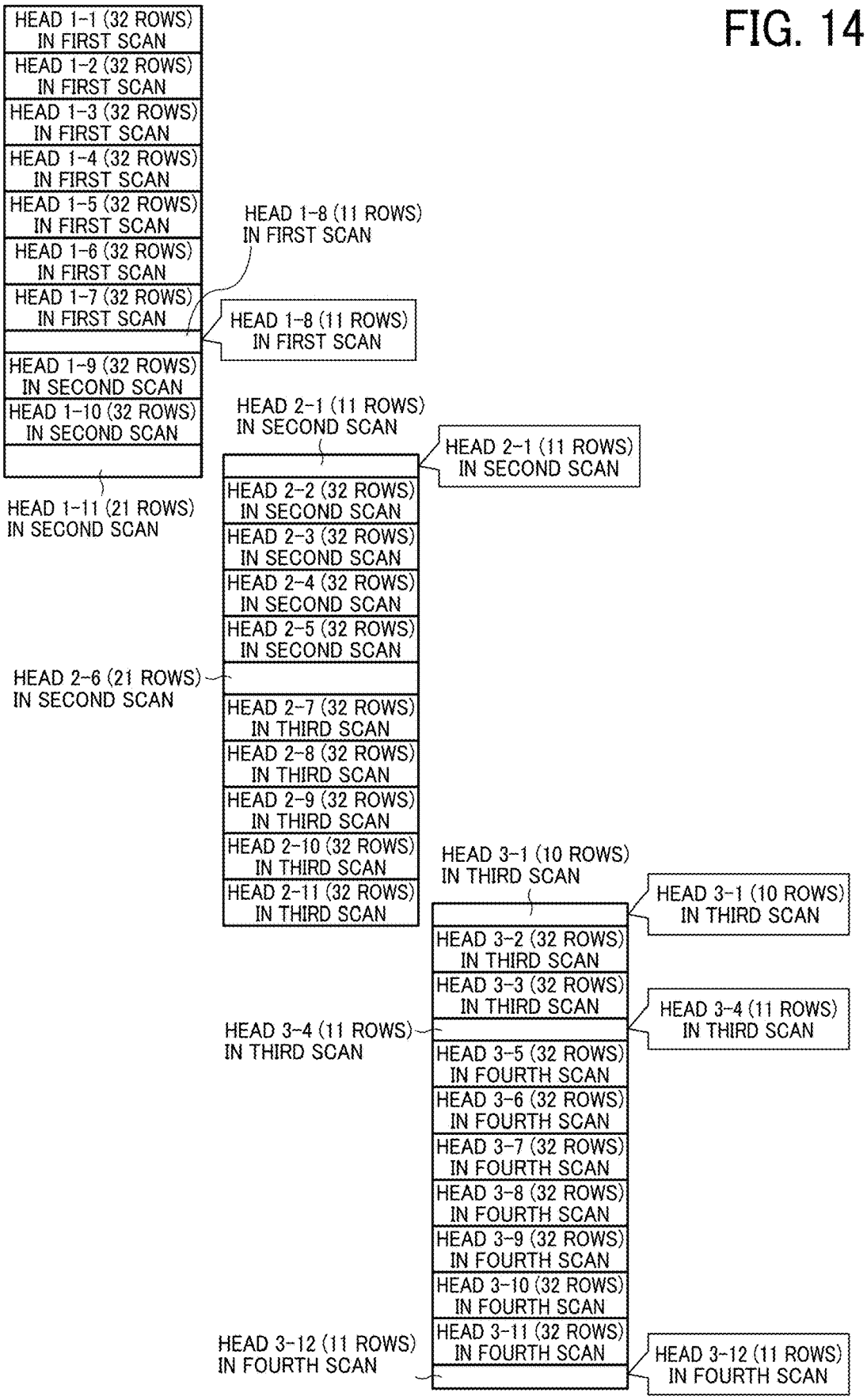
FIG. 14 is an illustration of the recording heads and nozzle rows used to print non-discharge detection patterns by four sub-scanning feeds.

FIG. 14 is an illustration of the recording heads and nozzle rows used to print non-discharge detection patterns by four sub-scanning feeds. When non-discharge detection patterns are printed by four sub-scanning feeds, as illustrated in FIG. 14, the heads 1-1 to 1-7 of the first recording head 41*a*, each of which includes 32 rows of nozzles, and 11 rows of the head 1-8 are used in the first scan. In the second scan, 32 rows of each of the heads 1-9 and 1-10 of the first recording head 41*a* and 21 lines of the head 1-11 are used. In the second scan, further, 11 rows of the head 2-1 of the second recording head 41*b* and 32 rows of each of the heads 2-2 to 2-5, and 21 rows of the head 2-6 are used.

In the third scan, the heads 2-7 to 2-11, each of which includes 32 rows, in the third recording head 41*c* are used. In the third scan, further, 10 rows of the head 3-1 of the third recording head 41*c*, 32 rows of each of the heads 3-2 and 3-3, and 11 rows of the head 3-4 are used.

In the fourth scan, 32 rows of each of the heads 3-5 to 3-11 and eleven rows of the head 3-12 of the third recording head 41*c* are used.

Designation of Printing Interval of Non-Discharge Detection Pattern The inkjet printer 1 according to the present embodiment can arbitrarily set a page or interval on which such non-discharge detection patterns are to be printed. In this case, the user operates the PC 11 or the operation panel 24 illustrated in FIG. 2 to designate a page (pages) on which non-discharge detection patterns are to be printed, for example, a first page, a fifth page, and so on. Alternatively, the user may designate pages on which non-discharge detection patterns are to be printed, such as every two pages or every four pages.

If non-discharge detection patterns are printed on each page (for all the pages), the productivity might decrease. However, the productivity can be secured by printing non-discharge detection patterns at intervals.

Effects of Embodiment As apparent from the above description, the inkjet printer 1 according to the present embodiment is provided with the two-dimensional image sensor 42 in alignment with the recording head 41. The system controller 31 prints a non-discharge detection pattern image for detecting a defective nozzle in a region other than the print region of the sheet, based on the feed amount of the sheet in the sub scanning direction and the length of the reading area of the two-dimensional image sensor 42 in the sub scanning direction. The non-discharge detection pattern is read by the two-dimensional image sensor 42. The geometric information calculator 65 detects, as a defective nozzle, a nozzle corresponding to a defective portion of a non-discharge detection pattern read by the two-dimensional image sensor 42, and notifies the system controller 31 of the nozzle detected as the defective nozzle.

The inkjet printer 1 according to the present embodiment forms and reads non-discharge detection patterns for detecting a non-discharge nozzle during a job with the number of nozzles of the recording head determined by the sub-scanning feed amount of the print image and the reading area of the two-dimensional image sensor 42. Such a configuration allows the non-discharge nozzles to be detected with a two-dimensional image sensor smaller than a line sensor. That is, a non-discharge nozzle of a recording head can be efficiently detected using a compact image sensor (two-dimensional image sensor). Thus, the inkjet printer 1 can be provided at an inexpensive price.

The system controller 31 controls driving of the recording head 41 to compensate the image formed by the non-discharge nozzle notified by the non-discharge nozzle number with another head or nozzle. Alternatively, the system controller 31 performs a recovery operation of controlling discharge of the nozzle of the notified non-discharge nozzle number, for example, for a predetermined time period or a predetermined number of times. Such a configuration can prevent generation of an abnormal image, such as a print image including white stripes generated due to non-discharge.

After the system controller 31 performs the above-described recovery operation, the geometric information calculator 65 compares again the subject image of the non-discharge detection pattern with the image of the non-discharge detection pattern serving as the reference stored in the memory 67 to detect the nozzle number (non-discharge nozzle number) of the non-discharge nozzle corresponding to the defective portion of the non-discharge detection pattern and notifies the non-discharge nozzle number to the system controller 31. The system controller 31 determines whether the nozzle on which the recovery operation has been performed has recovered, based on the non-discharge nozzle number notified from the geometric information processor 65. Such a configuration can prevent generation of an abnormal image, such as a print image including white stripes generated due to non-discharge.

Further, the two-dimensional image sensor 42 is disposed in alignment with the end of the recording head 41, thus allowing reading of the non-discharge detection pattern while reducing unnecessary scanning.

Finally, the above-described embodiments are presented as examples and are not intended to limit the scope of the present invention. The above-described embodiments can be implemented in other various forms, and various omissions, replacements, and changes can be made without departing from the scope of the invention. For example, although each of the above-described embodiments is described with an example of the inkjet printer, the present invention can also be applied to an electrophotographic apparatus. In addition, the embodiments and modifications or variations thereof are included in the scope and the gist of the invention, and are included in the invention described in the claims and the equivalent scopes thereof.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A liquid discharge apparatus comprising:

a liquid discharge head configured to discharge liquid to a target object;

a scanning device configured to move the liquid discharge head in a main scanning direction;

a conveyance device configured to convey the target object in a sub-scanning direction perpendicular to the main scanning direction;

a reading device disposed at a predetermined position with respect to the liquid discharge head;

control circuitry configured to change a detection pattern image for detecting a defective nozzle, in accordance with a feed amount of the target object in the sub-scanning direction; and a detecting device configured to identify a nozzle corresponding to a defective portion of the detection pattern image read by the reading device.

2. The liquid discharge apparatus according to claim 1, wherein the control circuitry is configured to change the detection pattern image in accordance with a number of times of feeds of the target object for applying the liquid in a width of the liquid discharge head in the sub scanning direction.

3. The liquid discharge apparatus according to claim 1, wherein the detection pattern image is formed together with a reference line having four corners or four sides.

4. The liquid discharge apparatus according to claim 1, wherein the detection pattern image is printed on a designated page or at designated page intervals.

5. The liquid discharge apparatus according to claim 1, wherein the control circuitry is configured to perform a defect recovery process on the defective nozzle detected by the detecting device.

6. The liquid discharge apparatus according to claim 5, wherein the detecting device is configured to detect a defective nozzle based on a detection pattern image formed after the defect recovery process and read by the reading device.

7. The liquid discharge apparatus according to claim 1, wherein the reading device is aligned with an end of the liquid discharge head in the sub-scanning direction.

8. A liquid discharge method for a liquid discharge apparatus including a liquid discharge head configured to discharge liquid to a target object, a scanning device configured to move the liquid discharge head in a main scanning direction, and a conveyance device configured to convey the target object in a sub-scanning direction perpendicular to the main scanning direction, the method comprising:

changing a detection pattern image for detecting a defective nozzle, in accordance with a feed amount of the target object in the sub-scanning direction;

reading the detection pattern image with a reading device disposed at a predetermined position with respect to the liquid discharge head; and identifying a nozzle corresponding to a defective portion of the detection pattern image read by the reading device.

* * * * *